US009969058B2

(12) United States Patent
Rizzo

(10) Patent No.: US 9,969,058 B2
(45) Date of Patent: May 15, 2018

(54) SYSTEM AND METHOD FOR CONTOURED PEEL GRINDING

(71) Applicant: UNITED TECHNOLOGIES CORPORATION, Farmington, CT (US)

(72) Inventor: John P. Rizzo, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 79 days.

(21) Appl. No.: 14/527,257

(22) Filed: Oct. 29, 2014

(65) Prior Publication Data

US 2015/0126096 A1 May 7, 2015

Related U.S. Application Data

(60) Provisional application No. 61/900,046, filed on Nov. 5, 2013.

(51) Int. Cl.
*B24D 7/18* (2006.01)

(52) U.S. Cl.
CPC ..... *B24D 7/18* (2013.01)

(58) Field of Classification Search
CPC ..... B24B 19/14; B24B 19/26; B24D 7/18; B24D 7/063; B24D 7/005; B24D 7/02; B24D 5/14; B24D 5/00; B24D 5/02; B24D 5/12; B24D 5/126
See application file for complete search history.

(56) References Cited

U.S. PATENT DOCUMENTS

| | | | | |
|---|---|---|---|---|
| 3,243,925 A * | 4/1966 | Buzzell | A61C 3/06 | 433/135 |
| 5,033,237 A * | 7/1991 | Slough | B24B 17/10 | 451/11 |
| 5,406,929 A * | 4/1995 | Udert | B24D 7/18 | 125/15 |
| 7,896,728 B2 * | 3/2011 | Schwartz | B24B 19/14 | 451/48 |
| 2004/0087256 A1 * | 5/2004 | Schwartz | B24D 7/18 | 451/56 |
| 2004/0198197 A1 * | 10/2004 | Schwartz | B24D 7/18 | 451/61 |

(Continued)

FOREIGN PATENT DOCUMENTS

| | | | |
|---|---|---|---|
| DE | 4039805 A1 * | 6/1992 | B24D 7/02 |
| WO | WO 2004067214 A2 * | 8/2004 | B23D 61/02 |

*Primary Examiner* — Christopher M Koehler
*Assistant Examiner* — Joel Crandall
(74) *Attorney, Agent, or Firm* — Cantor Colburn LLP

(57) ABSTRACT

A method for grinding out a contoured workpiece including providing a grinding wheel having a first abrasive work surface location and a second abrasive work surface location, the first abrasive work surface location having a first tangential radius and the second abrasive work surface location having a second tangential radius, the first and second tangential radii being different, grinding the workpiece at a first time with the first abrasive work surface location without the second abrasive work surface location performing grinding, and grinding the workpiece at a second time with the second abrasive work surface location without the first abrasive work surface location performing grinding.

22 Claims, 2 Drawing Sheets

(56) References Cited

U.S. PATENT DOCUMENTS

| | | | | |
|---|---|---|---|---|
| 2007/0135025 | A1* | 6/2007 | Huang | A63B 53/0466<br>451/59 |
| 2007/0232202 | A1* | 10/2007 | Schneeberger | B24B 3/36<br>451/45 |
| 2010/0132728 | A1* | 6/2010 | Busch | A45D 29/05<br>132/75.8 |
| 2011/0008172 | A1* | 1/2011 | Jette | B24B 19/02<br>416/219 R |

* cited by examiner

SYSTEM AND METHOD FOR CONTOURED PEEL GRINDING

CROSS REFERENCE TO RELATED APPLICATIONS

This Application claims priority to U.S. Provisional Patent Application No. 61/900,046, filed Nov. 5, 2013 and titled System and Method for Contoured Peel Grinding, the disclosure of which is hereby incorporate by reference in its entirety.

FIELD

The present disclosure relates generally to grounding processes, and, more particularly, to a contoured peel grounding process.

BACKGROUND

Certain types of workpieces can be advantageously shaped using grinding tools, such as a wheel or disc, which have an abrasive work surface. The abrasive particles on the surface of a rotating grinding wheel act primarily to cut or grind a workpiece as it is brought into contact therewith. The rotating grinding wheel is generally mounted in perpendicular to the workpiece, and steps along the workpiece to cut out a desired surface profile on the workpiece.

FIG. 1 illustrates a conventional peel grinding situation. A grinding wheel 102 is mounted in perpendicular to a workpiece 115. The grinding wheel 102 has an abrasive work surface 106 on at least a portion of a side of the grinding wheel 102. As shown in FIG. 1, the abrasive work surface 106 extends to an outer diameter of the grinding wheel 102 with a chamfered edge 108. When the grounding wheel rotates and is brought into contact with a surface of the workpiece 115, a top layer thereof will be peel grinded off as shown in FIG. 1.

While conventional peel grounding is generally effective at removing material quickly from workpiece, it is only so with straight and stepped grinding, and not capable for complex contoured grinding.

As such, what is desired is an effective grinding method for grinding contoured surface.

SUMMARY

Disclosed and claimed herein is a method for grinding out a contoured workpiece. In one embodiment, the method includes providing a grinding wheel having a first abrasive work surface location and a second abrasive work surface location, the first abrasive work surface location having a first tangential radius and the second abrasive work surface location having a second tangential radius, the first and second tangential radii being different, grinding the workpiece at a first time with the first abrasive work surface location without the second abrasive work surface location performing grinding, and grinding the workpiece at a second time with the second abrasive work surface location without the first abrasive work surface location performing grinding.

Other aspects, features, and techniques will be apparent to one skilled in the relevant art in view of the following detailed description of the embodiments.

BRIEF DESCRIPTION OF THE DRAWINGS

The drawings accompanying and forming part of this specification are included to depict certain aspects of the present disclosure. A clearer conception of the present disclosure, and of the components and operation of systems provided with the present disclosure, will become more readily apparent by referring to the exemplary, and therefore non-limiting, embodiments illustrated in the drawings, wherein like reference numbers (if they occur in more than one view) designate the same elements. The present disclosure may be better understood by reference to one or more of these drawings in combination with the description presented herein. It should be noted that the features illustrated in the drawings are not necessarily drawn to scale.

DETAILED DESCRIPTION

One aspect of the disclosure relates to a contoured peel grinding process. Embodiments of the present disclosure will be described hereinafter with reference to the attached drawings.

Figure 1:
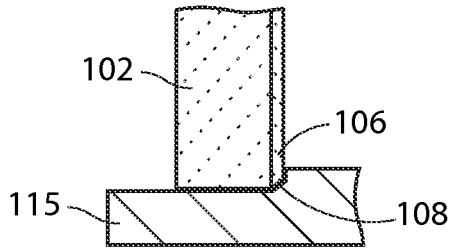
Fig. 1 (Prior Art)
FIG. 1 illustrates a conventional peel grinding situation.
Figure 2:
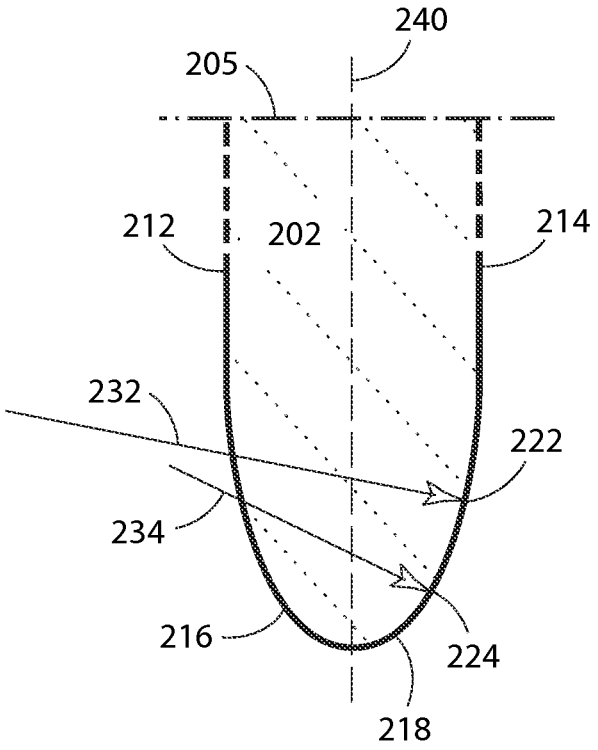
FIG. 2 is a cross-sectional view of a portion of a grinding wheel according to one embodiment of the present disclosure.

FIG. 2 is a cross-sectional view of a portion of a grinding wheel 202 according to one embodiment of the present disclosure. The cross-section is made by cutting through an axis 205 of the grinding wheel 202. As shown in FIG. 2, the grinding wheel 202 has two vertical outer surface 212 and 214 extended from the axis 205 to curved work surfaces 216 and 218, respectively. The vertical outer surface 212 and 214 are parallel to each other. Because the vertical outer surface 212 and 214 are generally not used for removing material, they may or may not be abrasive. The two curved work surfaces 216 and 218 smoothly transition to meet at a center line 240. Because the curved work surfaces 216 and 218 have to perform grinding work, abrasive materials are engrained therein for removing material when rotated at high speed. Although FIG. 2 shows a symmetrical cross-section of the grinding wheel 202, it should be realized that an asymmetrical grinding wheel may be more suited for certain jobs. It should be apparent that embodiments of the present disclosure described hereinafter applies equally well to grinding with either a symmetrical or an asymmetrical grinding wheel.

Referring to FIG. 2 again, in one embodiment, tangential radii of the curved work surface 218 gradually decrease from a junction point between the vertical outer surface 214 and the curved work surface 218 to a point on the center line 240. For instance, a curved work surface location 222 is further away from the center line 240 than another curved work surface location 224. A tangential radius 232 at the location 222 is larger than a tangential radius 234 at the location 224. Note that the tangential radius at a certain point on a curve refers to a radius that is perpendicular to a tangent of the point, and the radius equals to that of a circle most closely representing the curve at a vicinity of the point.

Figure 3:
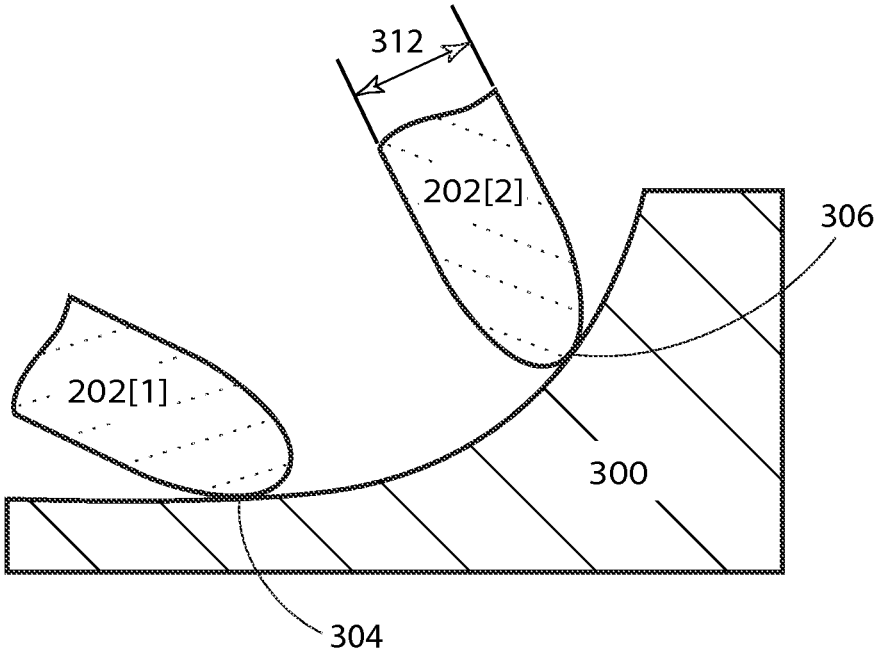
FIG. 3 is a diagram illustrating a contoured grinding process according to one embodiment of the present disclosure.

FIG. 3 is a diagram illustrating a grinding process for generating a contoured surface according to one embodiment of the present disclosure. A grinding wheel 202[1] represents the grinding wheel 202 at a first time, and a grinding wheel 202[2] represents the grinding wheel 202 at a second time. As shown in FIG. 3, the grinding wheel 202 has apparently changed both location and angle in reference to a workpiece 300. The location change can be a result of either moving the grinding wheel 202 or moving the workpiece 300 between the first time and the second time. The angle change can be a result of either a rotation of a machine tool the grinding wheeling being mounted to, or a rotation of the workpiece. When a multi-axis machine tool is used, both the grinding wheel and the workpiece can be rotated and linearly moved all at the same time.

Referring to FIG. 3 again, the grinding wheel 202[1] grinds the workpiece 300 at a location 304; and the grinding wheel 202[2] grinds the workpiece 300 at a location 306. As shown in FIG. 3, because the tangential radius of the grinding wheel 202[1] at its grinding location is larger than the tangential radius of the grinding wheel 202[2] at its grinding location, the tangential radius at location 304 is larger than the tangential radius at location 306. Apparently, the grinding wheel 202[1] and the grinding wheel 202[2] have different grinding locations, and only one of grinding locations is used for grinding at a time.

Because the grinding work surfaces 216 and 218 of the grinding wheel 202 has a smooth curve, grinded surface of the workpiece 300 can be finely controlled with a complex contour by finely rotating the grinding wheel. In addition, when the workpiece 300 is rotated at the same time during the grinding, a contoured cylindrical workpiece can be generated. In further addition, when the workpiece 300 is moved both horizontally and vertically at the same time during the grinding, a spline can be generated by the grinding. It should be apparent that the workpiece 300's horizontal or vertical movement can be replaced by the grinding wheel's movement with an equal distance yet in an opposite direction and achieves the same result. It should also be appreciated that when a pitch 312 of the grinding wheel 202, as shown in FIG. 3, become narrower, a finer contour of the workpiece 300 can be generated.

While this disclosure has been particularly shown and described with references to exemplary embodiments thereof, it shall be understood by those skilled in the art that various changes in form and details may be made therein without departing from the spirit of the claimed embodiments.

What is claimed is:

1. A method of grinding comprising:

providing a grinding wheel having a curvilinear first abrasive work surface location and a curvilinear second abrasive work surface location, the first abrasive work surface location having a first tangential radius and the second abrasive work surface location having a second tangential radius, the first and second tangential radii being different, the curvilinear first abrasive work surface and the curvilinear second abrasive work surface disposed at a same lateral side of the grinding wheel relative to a central plane of the grinding wheel;

grinding a curvilinear surface of a workpiece at a first time with the first abrasive work surface location without the second abrasive work surface location performing grinding; and grinding the curvilinear surface of the workpiece at a second time with the second abrasive work surface location without the first abrasive work surface location performing grinding.

2. The method of claim 1, wherein the first abrasive work surface location is further away from the central plane of the grinding wheel than the second abrasive work surface location, and the first tangential radius is larger than the second tangential radius.

3. The method of claim 1, wherein the grinding wheel is positioned at a first angle to a reference plane at the first time and positioned at a second angle to the reference plane at the second time, the first angle being different from the second angle.

4. The method of claim 1, wherein the abrasive work surface of the grinding wheel has a smooth transition from the first abrasive work surface location to the second abrasive work surface location.

5. The method of claim 1, wherein the tangential radii of the workpiece as results of the grinding at the first and second time are different.

6. The method of claim 1, wherein the workpiece is moved from one location to another between the first and the second time.

7. The method of claim 1, wherein a machine tool the grinding wheel being mounted thereon is moved from one location to another between the first and second time.

8. The method of claim 1, wherein the workpiece is rotated during the grinding.

9. A method of grinding comprising:

providing a grinding wheel having a curvilinear first abrasive work surface location and a curvilinear second abrasive work surface location, the first abrasive work surface location having a first tangential radius and the second abrasive work surface location having a second tangential radius, the first abrasive work surface and the second abrasive work surface disposed at a same lateral side of the grinding wheel relative to a central plane of the grinding wheel, the first abrasive work surface location being further away from the central plane of the grinding wheel than the second abrasive work surface location, the first tangential radius being larger than the second tangential radius;

grinding a curvilinear surface of a workpiece at a first time with the first abrasive work surface location without the second abrasive work surface location performing grinding; and grinding the curvilinear surface of the workpiece at a second time with the second abrasive work surface location without the first abrasive work surface location performing grinding.

10. The method of claim 9, wherein the grinding wheel is positioned at a first angle to a reference plane at the first time and positioned at a second angle to the reference plane at the second time, the first angle being different from the second angle.

11. The method of claim 9, wherein the abrasive work surface of the grinding wheel has a smooth transition from the first abrasive work surface location to the second abrasive work surface location.

12. The method of claim 9, wherein the tangential radius of the workpiece as a result of the grinding at the first time is larger than the tangential radius of the workpiece as a result of the grinding at the second time.

13. The method of claim 9, wherein the workpiece is moved from one location to another between the first and the second time.

14. The method of claim 9, wherein a machine tool the grinding wheel being mounted thereon is moved from one location to another between the first and the second time.

15. The method of claim 9, wherein the workpiece is rotated during the grinding.

16. A method of grinding composing:

providing a grinding wheel having a curvilinear first abrasive work surface location and a curvilinear second abrasive work surface location, the first abrasive work surface location having a first tangential radius and the second abrasive work surface location having a second tangential radius, the first and second tangential radii being different, an abrasive work surface of the grinding wheel having a smooth transition from the first abrasive work surface location to the second abrasive work surface location, the curvilinear first abrasive work surface location and the curvilinear second abrasive work surface location disposed at a same lateral side of the grinding wheel relative to a central plane of the grinding wheel;

grinding a curvilinear surface of a workpiece at a first time with the abrasive work surface location without the second abrasive work surface location performing grinding; and grinding the curvilinear surface of the workpiece at a second time with the second abrasive work surface location without the first abrasive work surface location performing grinding.

17. The method of claim 16, wherein the first abrasive work surface location is further away from a central plane of the grinding wheel than the second abrasive work surface location, and the first tangential radius is larger than the second tangential radius.

18. The method of claim 16, wherein the grinding wheel is positioned at a first angle to a reference plane at the first time and positioned at a second angle to the reference plane at the second time, the first angle being different from the second angle.

19. The method of claim 16, wherein tangential radii of the workpiece as results of the grinding at the first and second time are different.

20. The method of claim 16, wherein the workpiece is moved from one location to another between the first and the second time.

21. The method of claim 16, wherein a machine tool the grinding wheel being mounted thereon is moved from one location to another between the first and second time.

22. The method of claim 16, wherein the workpiece is rotated during the grinding.

* * * * *